US007144480B2

(12) United States Patent
Davis

(10) Patent No.: US 7,144,480 B2
(45) Date of Patent: Dec. 5, 2006

(54) GROOVED BELT WITH REBATES

(75) Inventor: Trent Davis, Mansfield, MA (US)

(73) Assignee: Albany International Corp., Albany, NY (US)

( * ) Notice: Subject to any disclaimer, the term of this patent is extended or adjusted under 35 U.S.C. 154(b) by 570 days.

(21) Appl. No.: 10/418,228

(22) Filed: Apr. 17, 2003

(65) Prior Publication Data

US 2006/0011320 A1 Jan. 19, 2006

(51) Int. Cl.
*D21F 3/02* (2006.01)
*B26D 3/06* (2006.01)

(52) U.S. Cl. ..... 162/358.4; 162/901; 428/131; 428/167; 83/875; 83/935

(58) Field of Classification Search ..... 162/204–207, 162/358.1, 358.2, 358.3, 358.4, 900, 901, 162/306; 428/131–136, 156, 167, 182; 492/20, 492/30; 100/118, 121; 83/875–878, 935
See application file for complete search history.

(56) References Cited

U.S. PATENT DOCUMENTS

| | | | | |
|---|---|---|---|---|
| 1,925,917 | A * | 9/1933 | Chalon | 428/132 |
| 4,206,258 | A * | 6/1980 | Balcar | 428/131 |
| 4,446,187 | A * | 5/1984 | Eklund | 428/136 |
| 4,946,731 | A | 8/1990 | Dutt | |
| 4,978,428 | A | 12/1990 | Cronin et al. | |
| 5,208,087 | A | 5/1993 | Stigberg | |
| 5,543,015 | A | 8/1996 | Jermo | |
| 6,029,570 | A | 2/2000 | Matuschczyk | |
| 6,086,719 | A | 7/2000 | Hasegawa et al. | |
| 6,136,151 | A | 10/2000 | Davenport et al. | |
| 6,296,738 | B1 | 10/2001 | Ishii | |
| 6,416,630 | B1 * | 7/2002 | Matuschczyk et al. | 162/358.4 |
| 6,428,874 | B1 | 8/2002 | McGahern et al. | |
| 6,447,648 | B1 | 9/2002 | Slagowski et al. | |
| 2002/0153116 | A1 | 10/2002 | Honkalampi et al. | |
| 2004/0069432 | A1 * | 4/2004 | Hansen | 162/358.2 |

FOREIGN PATENT DOCUMENTS

| | | | |
|---|---|---|---|
| DE | 44 01 580 | * | 6/1994 |
| DE | 44 01 580 | A | 6/1994 |
| DE | 44 11 621 | A | 10/1995 |
| DE | 196 37 477 | A | 3/1998 |
| EP | 0 953 678 | A | 11/1999 |
| EP | 1 136 618 | A | 9/2001 |

* cited by examiner

*Primary Examiner*—Eric Hug
(74) *Attorney, Agent, or Firm*—Frommer Lawrence & Haug LLP; Ronald R. Santucci

(57) ABSTRACT

A shoe press belt having formed on an outer surface a plurality of parallel machine direction grooves. Each groove has formed therein a plurality of conical rebates. The rebates are spaced along each groove with centers coincident with the groove center line. The positions of the rebates are stepped diagonally across adjacent parallel grooves.

7 Claims, 4 Drawing Sheets

Plan View

Plan View

Section View

GROOVED BELT WITH REBATES

BACKGROUND OF THE INVENTION

1. Field of the Invention

The present invention is directed towards a belt use in papermaking, more particularly, a grooved belt having rebates for use in the press section of a papermaking machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Contemporary papermaking fabrics are produced in a wide variety of styles designed to meet the requirements of the paper machines on which they are installed for the paper grades being manufactured. Generally, they comprise a woven base fabric. The base fabrics may be woven from monofilament, plied monofilament, multifilament or plied multifilament yarns, and may be single-layered, multi-layered or laminated. The yarns are typically extruded from any one of the synthetic polymeric resins, such as polyamide and polyester resins, used for this purpose by those of ordinary skill in the paper machine clothing arts.

The woven base fabrics themselves take many different forms. For example, they may be woven endless, or flat woven and subsequently rendered into endless form with a woven seam. Alternatively, they may be produced by a process commonly known as modified endless weaving, wherein the widthwise edges of the base fabric are provided with seaming loops using the machine-direction (MD) yarns thereof. In this process, the MD yarns weave continuously back-and-forth between the widthwise edges of the fabric, at each edge turning back and forming a seaming loop. A base fabric produced in this fashion is placed into endless form during installation on a paper machine, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

Further, the woven base fabrics may be laminated by placing at least one base fabric within the endless loop formed by another, and by needling a staple fiber batt through these base fabrics to join them to one another. One or more of these woven base fabrics may be of the on-machine-seamable type. This is now a well known laminated press fabric with a multiple base support structure.

In any event, the woven base fabrics are in the form of endless loops, or are seamable into such forms, having a specific length, measured longitudinally therearound, and a specific width, measured transversely thereacross.

Traditional press sections include a series of nips formed by pairs of adjacent cylindrical press rolls. Recently, the use of long press nips has been found to be advantageous over the use of nips formed by pairs of adjacent rolls. The longer the web can be subjected to pressure in the nip, the more water can be removed there, and, consequently, the less will remain to be removed through evaporation in the dryer section.

In long nip presses of the shoe type variety, the nip is formed between a cylindrical press roll and an arcuate pressure shoe. The latter has a cylindrically concave surface having a radius of curvature close to the cylindrical press roll. When roll and shoe are brought into close physical proximity, a nip is formed which can be five to ten times longer in the machine direction than one formed between two press rolls. This increases the so-called dwell time of the fibrous web in the long nip while maintaining the same level of pressure per square inch pressing force used in a two-roll press. The result of this long nip technology has been a dramatic increase in dewatering of the fibrous web in the long nip when compared to conventional roll nips on paper machines.

A long nip press of the shoe type requires a special belt. This belt is designed to protect the press fabric supporting, carrying, and dewatering the fibrous web from the accelerated wear that would result from direct, sliding contact over the stationary pressure shoe. Such a belt must be made with a smooth impervious surface that rides, or slides over the stationary shoe on a lubricating film of oil. The belt moves through the nip at roughly the same speed as the press fabric.

Belts of such variety are made, for example, by impregnating a woven base fabric, which takes the form of an endless loop, with a synthetic polymeric resin. Preferably, the resin forms a coating of some predetermined thickness on the inner surface of the belt, so that the yarns from which the base fabric is woven may be protected from direct contact with the arcuate pressure shoe component of the long nip press.

It is often desirable to provide the belt with a resin coating of some predetermined thickness on its outer surface as well as on its inner surface. Moreover, when the outer surface of the belt has a resin coating of some predetermined thickness, it permits grooves, blind-drilled holes or other cavities to be formed on that surface without exposing any part of the woven base fabric. These features provide for the temporary storage of water pressed from the web in the press nip. In fact, for some long nip press configurations the presence of some void volume, provided by grooves, blind-drilled holes or the like, on the outer surface of the belt is a necessity.

The present invention relates to shoe press belts having a plurality of grooves and rebates in the machine direction located in the resin coating on the outer surface thereof.

SUMMARY OF THE INVENTION

The present invention relates to a shoe press belt having formed on an outer surface a plurality of parallel machine direction grooves. Each groove has formed therein a plurality of conical rebates. The rebates are spaced along each groove with centers coincident with the groove center line. The positions of the rebates are stepped diagonally across parallel grooves.

DETAILED DESCRIPTION OF THE PREFERRED EMBODIMENTS

A preferred embodiment of the invention will be described in the context of papermaking machine shoe press belts. However, it should be noted that the invention is applicable to process belts used in other sections of a paper machine, as well as to those used in other industrial settings where it is an advantage to have belts that facilitate dewatering.

Figure 1:
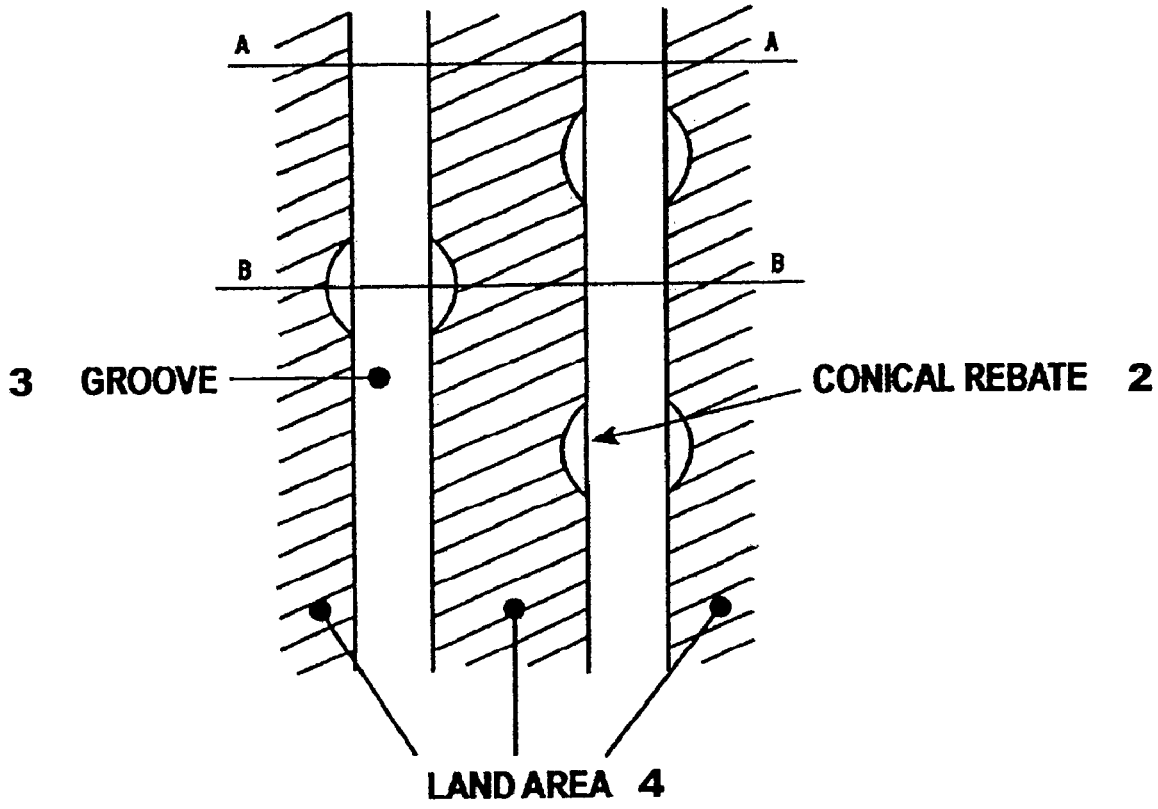
FIG. 1 is a plan view of the shoe press belt according to the present invention.
Figure 2:
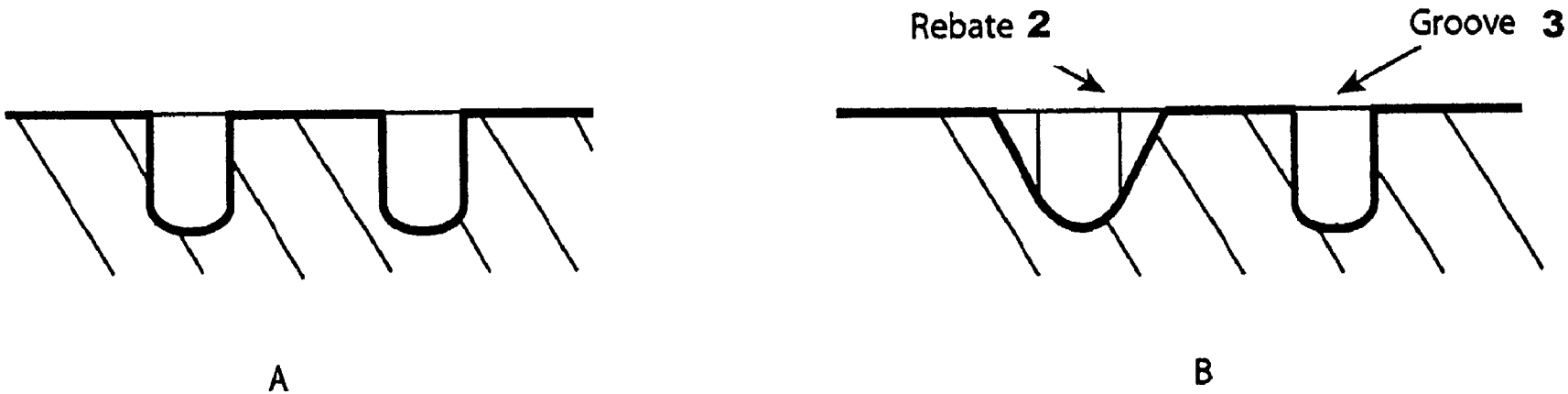
FIG. 2A is a section view in the machine direction of the belt in FIG. 1 prior to rebating.
FIG. 2B is a section view in the machine direction after rebating is performed.

FIG. 1 is a plan view of a grooved shoe press belt 1 according to one embodiment of the present invention. FIGS. 2A and 2B are cross sections of belt 1 viewed in the machine direction. Before describing belt 1 in further detail, however, certain general comments are in order. To facilitate dewatering in an extended nip press, a typical prior art shoe press belt has longitudinal grooves formed in its surface to vent air and water from the sheet and the press fabric as it passes through the nip. However, this conventional belt may suffer from some degree of groove closure ranging from none to complete groove closure as the belt matrix material deflects under the nip load causing the two land areas on either side of the groove to contact and prevent the venting so crucial to belt performance.

Figure 3:
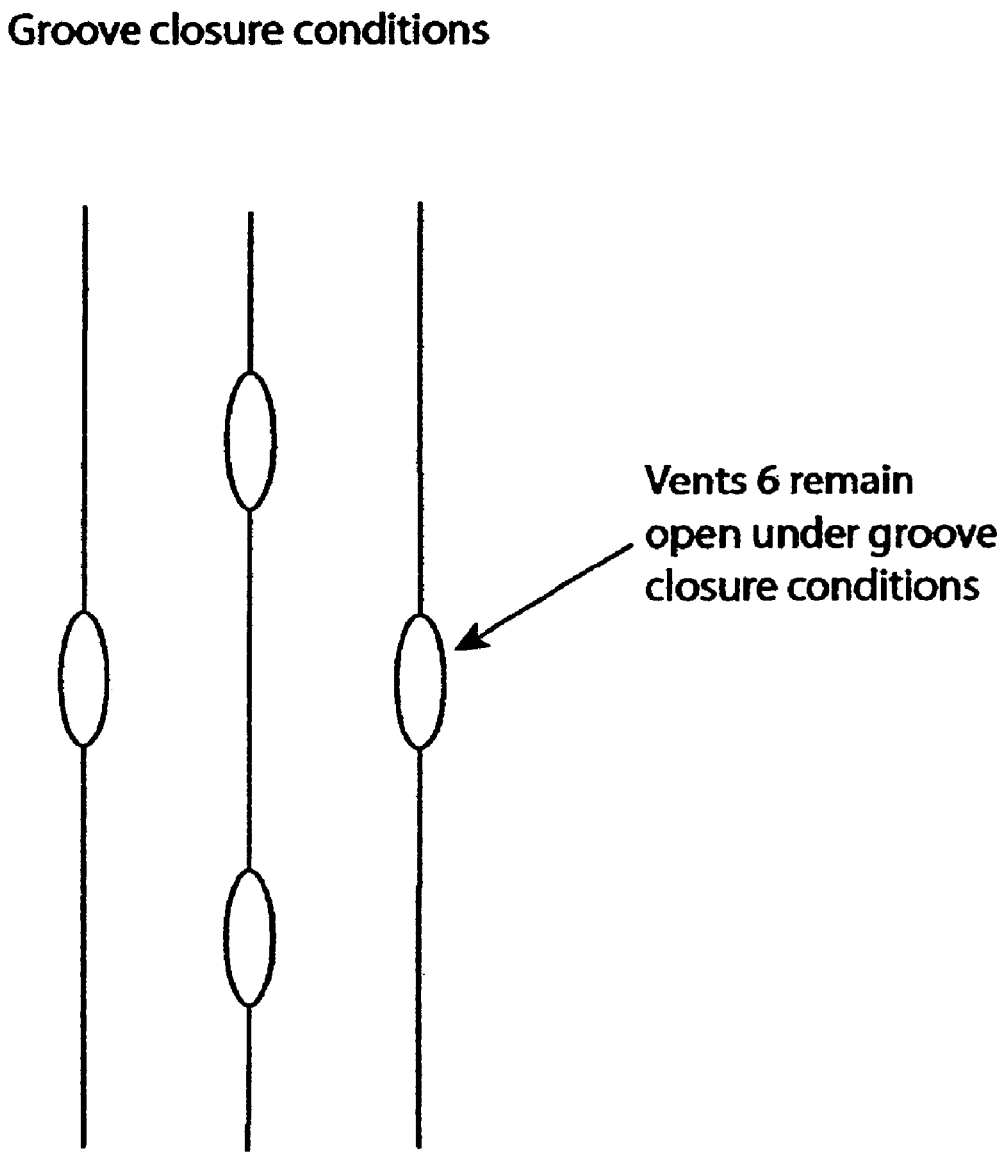
FIG. 3 is a plan view of the present invention with open vents under groove closure conditions.

The belt 1 of the present invention solves this problem by adding an array of conical rebates 2 to each groove 3. Advantageously, the rebate 2 is an additional void put in the belt 1 to allow water flow into the belt grooves 3 while belt 1 is still in the press nip, as shown in FIG. 2B. As further illustrated in FIG. 3, the rebates 2 prevent complete groove closure under pressure by providing vents 6 into the grooves 3 and hence improve dewatering. That is, the vents 6 allow water flow into the belt grooves 3 while the belt 1 is still in the press nip. The rebates 2 are spaced along the machine direction (MD) grooves 3 with, preferably, centers coincident with the MD groove center lines. The positions of the rebates 2 are stepped for example, diagonally across adjacent parallel grooves to minimize local land area 4 weakness.

Note in FIG. 2B that the profile of the rebate 2 is slightly larger than the groove 3 opening at the top, but tapers down to eventually match the profile of at least the bottom portion of the groove 3. Note further that the rebates 2 extend no deeper than the groove 3 depth. Most preferably, the rebates 2 only occur centered on, and not offset from, the grooves 3. Finally, note that the rebate 2 does not change the general shape of the groove 3 except in the specific locations of the rebates 2.

In a further embodiment of the belt 1 according to the present invention, the shape of one or more of the conical rebates may be modified. As one example, the shape the conical rebate may be elongated along the machine direction of the groove. However, other types of shaping of the conical rebate are also contemplated. This shaping of the conical rebates may, for example, further enhance the previously described advantages of the inventive belt 1 (such as improved dewatering) in particular applications.

Figure 4:
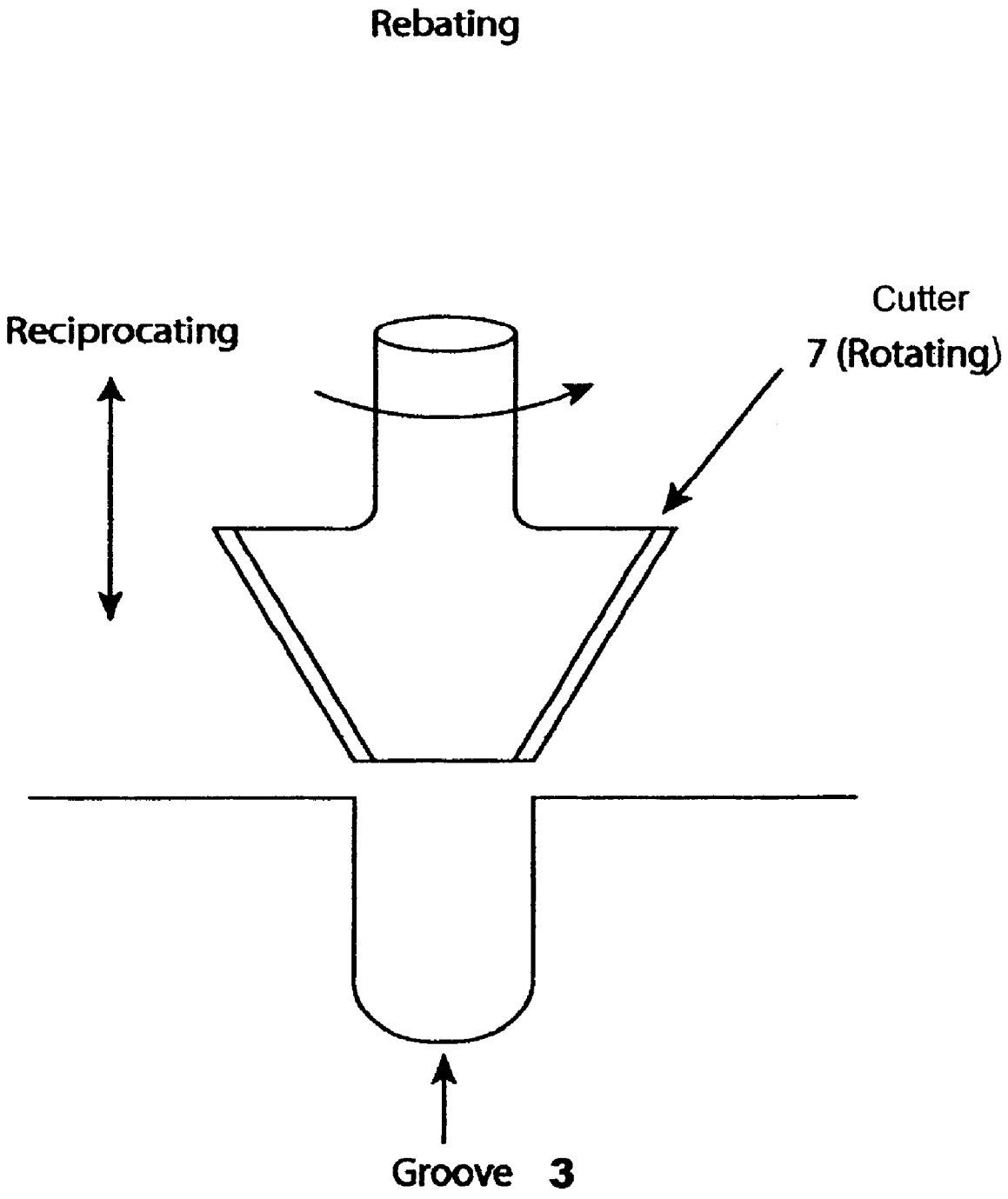
FIG. 4 is a section view of the rebating process according to the invention.

FIG. 4 illustrates the rebating process used in the manufacture of the belt 1. The rebates 2 may be created at the same time as the grooves 3 to insure alignment and minimize processing time. Both the rebates 2 and the grooves 3 can be created by cutting. However other means suitable for the purpose to create the rebates 2 and grooves 3 may also be utilized by one skilled in the art.

Rebate cutters 7 are aligned with groove cutters (not shown) and reciprocated in-process to give required spacing. The exact dimensions and profiles of the rebates 2 will depend upon each particular application. In this connection, it is noted that the conical rebate 2 having, for example, the above-described elongated shape, may be formed by simply delaying the cutters 7 at the bottom of their stroke typically for a fraction of a second. This would give the rebates 2 their oval or elongated shape as opposed to a pure cone, for instance.

There exist important differences between the present invention and that taught in U.S. Pat. No. 6,029,570 ("'570 patent") The '570 patent teaches a belt having both grooves and blind drilled holes. Note however that the blind drilled holes are only coincident with at least one groove. Although the '570 patent teaches that the "grooves are coupled through the centers of the blind holes" (col. 2, lines 55–56), note that the '570 patent also teaches that the blind drilled holes are the main water storage volume, and that the grooves are almost unnecessary. Therefore, the holes do not function as conduits for water transfer into the grooves under load. Further, the blind drilled holes are cylindrical in shape and can extend beyond the depth of the grooves. More importantly, the pattern of holes to grooves is not important for the '570 belt to function.

The present invention is also different from that in foreign document DE 44 11 621. This document teaches a grooved belt having a so-called "surface void." However, the '621 belt has, specifically, teardrop-shaped grooves which are purposely designed to close up completely under pressure and thus do not absorb water in the press nip, but rather upon leaving the nip in an attempt to control rewet of the paper sheet. Further, the '621 belt has "blind drilled" holes, not rebates, centered on the grooves. These "holes" extend only from the belt surface to the top of the specially designed groove as seen in FIGS. 3–5 and 8–10. Furthermore these "holes" are described in claim 2 as the "first area (28) beginning at the surface of the belt (20)." In the same claim, the groove is described as the "second area (30) with a greater cross section than the first area (28)."

Modifications to the above would be obvious to those of ordinary skill in the art, but would not bring the invention so modified beyond the scope of the present invention. The claims to follow should be construed to cover such situations.

I claim:

1. A shoe press belt having a plurality of machine direction grooves formed on the surface thereof, and each groove having a plurality of conical rebates formed therein, wherein the rebate profile is wider at its open top than that of the groove so as to extend into land areas separating adjacent grooves, tapers down to a width of the groove bottom, and has a depth less than or equal to that of the groove.

2. The belt in claim 1, wherein the rebates are spaced along each groove with centers coincident with the groove center line.

3. The belt in claim 1, wherein the positions of the rebates are stepped diagonally across adjacent parallel grooves.

4. The belt in claim 1, wherein the rebates inhibit groove closure under pressure so as to vent water into the grooves thereby improving sheet dewatering.

5. The belt in claim 1, wherein the shape of one or more of the conical rebates is elongated along the machine direction of the groove.

6. A method used to form grooves and rebates on a belt surface, the method comprising:

forming a plurality of longitudinal grooves in the belt surface; and forming an array of conical rebates in each groove; wherein the rebates are spaced along each groove, have their centers aligned coincident with the groove center line, and the positions of the rebates are stepped diagonally across adjacent parallel grooves, and wherein the shape of one or more of the conical rebates is elongated along the machine direction of the groove.

7. The method of claim 6, wherein the rebate having an elongated shape is formed by delaying a cutting stroke for a predetermined period.

* * * * *